US006751995B1

(12) United States Patent
Sabasta

(10) Patent No.: US 6,751,995 B1
(45) Date of Patent: Jun. 22, 2004

(54) ROLL BENDING DIE

(76) Inventor: Steven W. Sabasta, 1210 Steuben St., Sioux City, IA (US) 51105

( * ) Notice: Subject to any disclaimer, the term of this patent is extended or adjusted under 35 U.S.C. 154(b) by 0 days.

(21) Appl. No.: 10/215,614

(22) Filed: Aug. 9, 2002

(51) Int. Cl.[7] ..... B21D 5/14

(52) U.S. Cl. ..... 72/168; 72/166; 72/177; 72/182; 492/1; 492/16

(58) Field of Search ..... 72/168, 166, 177, 72/180, 182; 492/1, 2, 16

(56) References Cited

U.S. PATENT DOCUMENTS

| | | | | | |
|---|---|---|---|---|---|
| 2,327,706 | A | | 8/1943 | Halstead | |
| 2,600,442 | A | * | 6/1952 | Stanius | 72/166 |
| 2,719,562 | A | | 10/1955 | Beegle | |
| 2,769,477 | A | | 11/1956 | Neer | |
| 3,040,799 | A | * | 6/1962 | Hanson | 72/182 |
| 3,150,707 | A | * | 9/1964 | Howell | 72/177 |
| 3,304,757 | A | | 2/1967 | Achler et al. | |
| 3,357,222 | A | | 12/1967 | Konstandt | |
| 3,485,076 | A | * | 12/1969 | Colburn | 72/179 |
| 3,535,903 | A | * | 10/1970 | Abernathy | 72/181 |
| 3,608,347 | A | | 9/1971 | Kemminer | |
| 3,610,011 | A | * | 10/1971 | Valentine | 72/177 |
| 3,667,265 | A | * | 6/1972 | Zippe | 72/182 |
| 4,063,442 | A | | 12/1977 | Martin, Sr. | |
| 4,286,451 | A | * | 9/1981 | Chang | 72/177 |
| 4,777,816 | A | | 10/1988 | Inoue | |
| 5,139,134 | A | | 8/1992 | Schenck | |
| 5,522,245 | A | * | 6/1996 | Nozaki et al. | 72/166 |

FOREIGN PATENT DOCUMENTS

| | | | | |
|---|---|---|---|---|
| JP | 156025 | * | 7/1987 | 72/168 |
| SU | 494898 | * | 8/1981 | 72/168 |

* cited by examiner

*Primary Examiner*—Daniel C. Crane

(57) ABSTRACT

A roll bending die for bending metal into an arc with reinforcing ribs and tapered ends. The roll bending machine includes a body member being designed for being rotatably coupled to the roll bending machine whereby the body member selectively engages a pliable roller of the roll bending machine. The body member is designed for being rotated by the pliable roller when the pliable roller is rotated by the roll bending machine whereby the body member rolls the material into an arc when the material is placed between the body member and the pliable roller. The body member comprises a plurality of ridge portions outwardly extending from a perimeter face of the body member. The ridge portions are designed for pressing ribs into the material when the material is rolled between the body member and the pliable roller of the roll bending machine.

23 Claims, 7 Drawing Sheets

ROLL BENDING DIE

BACKGROUND OF THE INVENTION

1. Field of the Invention

The present invention relates to metal forming machines and more particularly pertains to a new roll bending die for bending metal into an arc with reinforcing ribs and tapered ends.

2. Description of the Prior Art

The use of metal forming machines is known in the prior art. U.S. Pat. No. 2,719,562 describes a device for forming metal channels and tubes. Another type of metal forming machine is U.S. Pat. No. 3,304,757 having a pair of smooth rollers for rolling a sheet metal into an arcuate shape. U.S. Pat. Nos. 4,777,816, 2,769,477, 4,063,442, 5,139,134, 3,608,347, 3,357,222, and 2,327,706 each use a smooth roller for rolling the material into an arcuate shape.

While these devices fulfill their respective, particular objectives and requirements, the need remains for a device that has certain improved features to allow reinforcing ridges to be rolled into a material.

SUMMARY OF THE INVENTION

The present invention meets the needs presented above by providing the body member with at least one ridge portion for forming a ridge in the material when it is being rolled to provide reinforcement against being of the material.

Still yet another object of the present invention is to provide a new roll bending die that eliminates the non-arcuate leading edge formed when the material to starting to be rolled allowing for the final product to have a continuous arc.

Even still another object of the present invention is to provide a new roll bending die that increases manufacture time and efficiency of making rib reinforced arcuate shapes over the traditional method of stamping the material into shape.

Even still another object of the present invention is to provide a new roll bending die that increases production output by allow multiple layers of material to be rolled at the same time allowing for multiple copies of the end product to be made simultaneously. The ridge portions of the body member press into the multiple layers of material and prevent the layers from slipping apart while being rolled thereby allowing multiple copies of the end product to be rolled simultaneously using the same body member.

To this end, the present invention generally comprises a body member being designed for being rotatably coupled to the roll bending machine whereby the body member selectively engages a pliable roller of the roll bending machine. The body member is designed for being rotated by the pliable roller when the pliable roller is rotated by the roll bending machine whereby the body member rolls the material into an arc when the material is placed between the body member and the pliable roller. The body member comprises a plurality of ridge portions outwardly extending from a perimeter face of the body member. The ridge portions are designed for pressing ribs into the material when the material is rolled between the body member and the pliable roller of the roll bending machine.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
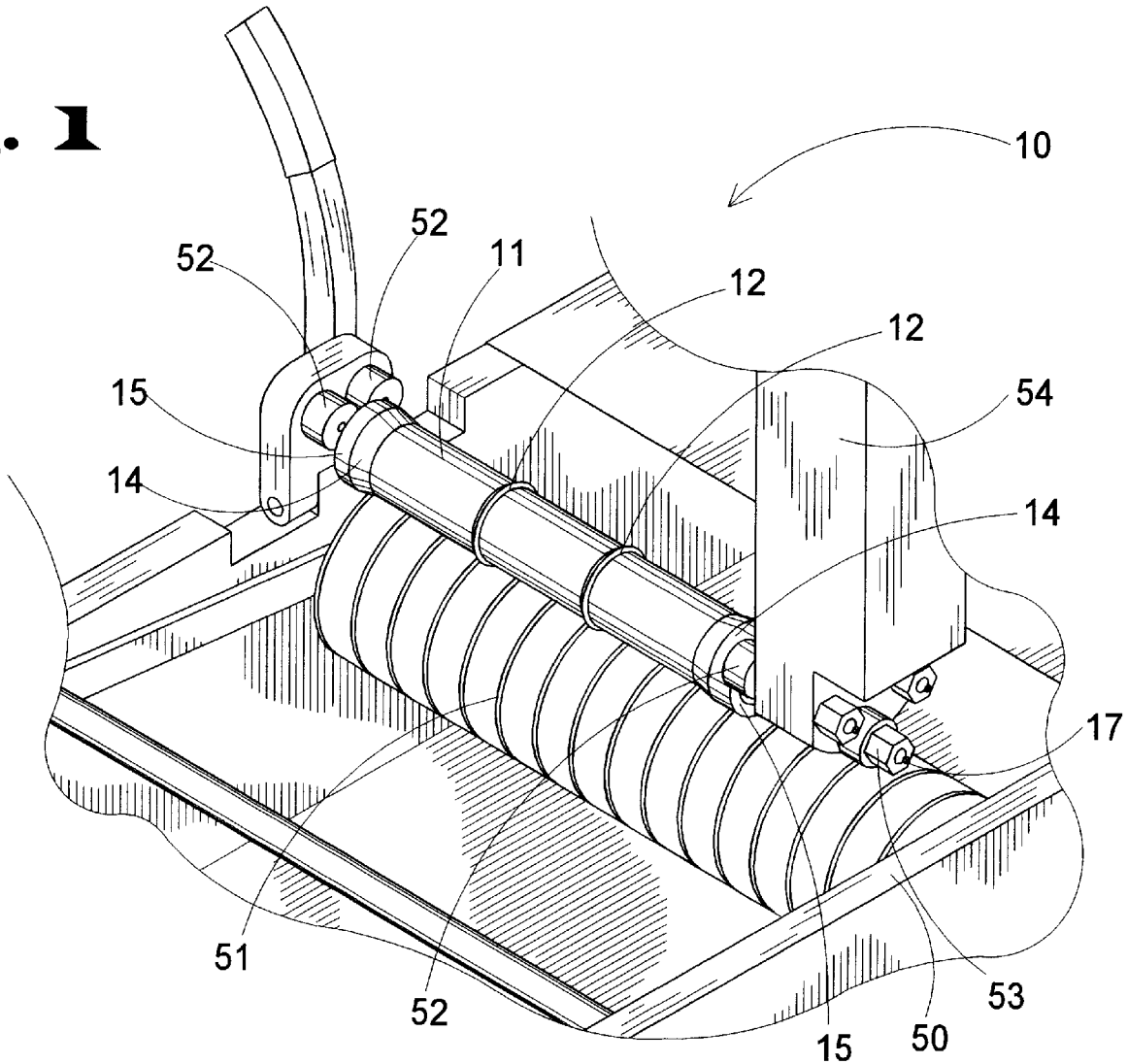
FIG. 1 is a perspective view of a new roll bending die according to the present invention shown in use.

With reference now to the drawings, and in particular to FIGS. 1 through 7 thereof, a new roll bending die embodying the principles and concepts of the present invention and generally designated by the reference numeral 10 will be described.

As best illustrated in FIGS. 1 through 7, the roll bending die 10 generally comprises a body member 11 being designed for being rotatably coupled to the roll bending machine 50 whereby the body member 11 selectively engages a pliable roller 51 of the roll bending machine 50. The body member 11 is designed for being rotated by the pliable roller 51 when the pliable roller 51 is rotated by the roll bending machine 50 whereby the body member 11 rolls the material into an arc when the material is placed between the body member 11 and the pliable roller 51.

The body member 11 comprises a plurality of ridge portions 12 outwardly extending from a perimeter face 13 of the body member 11. The ridge portions 12 are designed for pressing ribs into the material when the material is rolled between the body member 11 and the pliable roller 51 of the roll bending machine 50.

Each of the ridge portions 12 annularly extends around the body member 11 whereby each of the ridge portions 12 extends around the circumference of the body member 11. The ridge portions 12 are designed for forming circumferential ridges in the material when the material is rolled between the body member 11 and the pliable roller 51 for reinforcing the material against bending.

The body member 11 comprises a pair of flared ridges 14. Each of the flared ridges 14 outwardly extends from the perimeter face 13 of the body member 11 whereby the flared ridges 14 are designed for forming a flared portion in the material when the material is rolled between the body member 11 and the pliable roller 51.

Each of the flared ridges 14 of the body member 11 annularly extends around the body member 11 whereby each of the flared ridges 14 extends around the circumference of the body member 11. The flared ridges 14 are designed for forming circumferential flared portions in the material when the material is rolled between the body member 11 and the pliable roller 51 for reinforcing the material against bending.

Each of the flared ridges 14 of the body member 11 is positioned adjacent one of a pair of opposing ends 15 of the body member 11 whereby the flared ridges 14 are designed for forming the circumferential flared portions adjacent each of the free ends of the material when the material is rolled between the body member 11 and the pliable roller 51.

Figure 2:
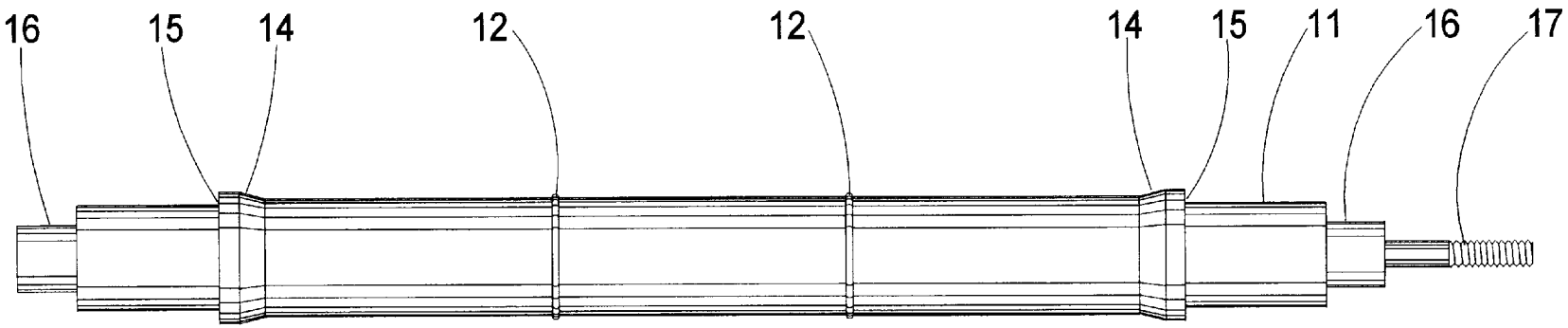
FIG. 2 is a perspective view of the present invention.
Figure 3:
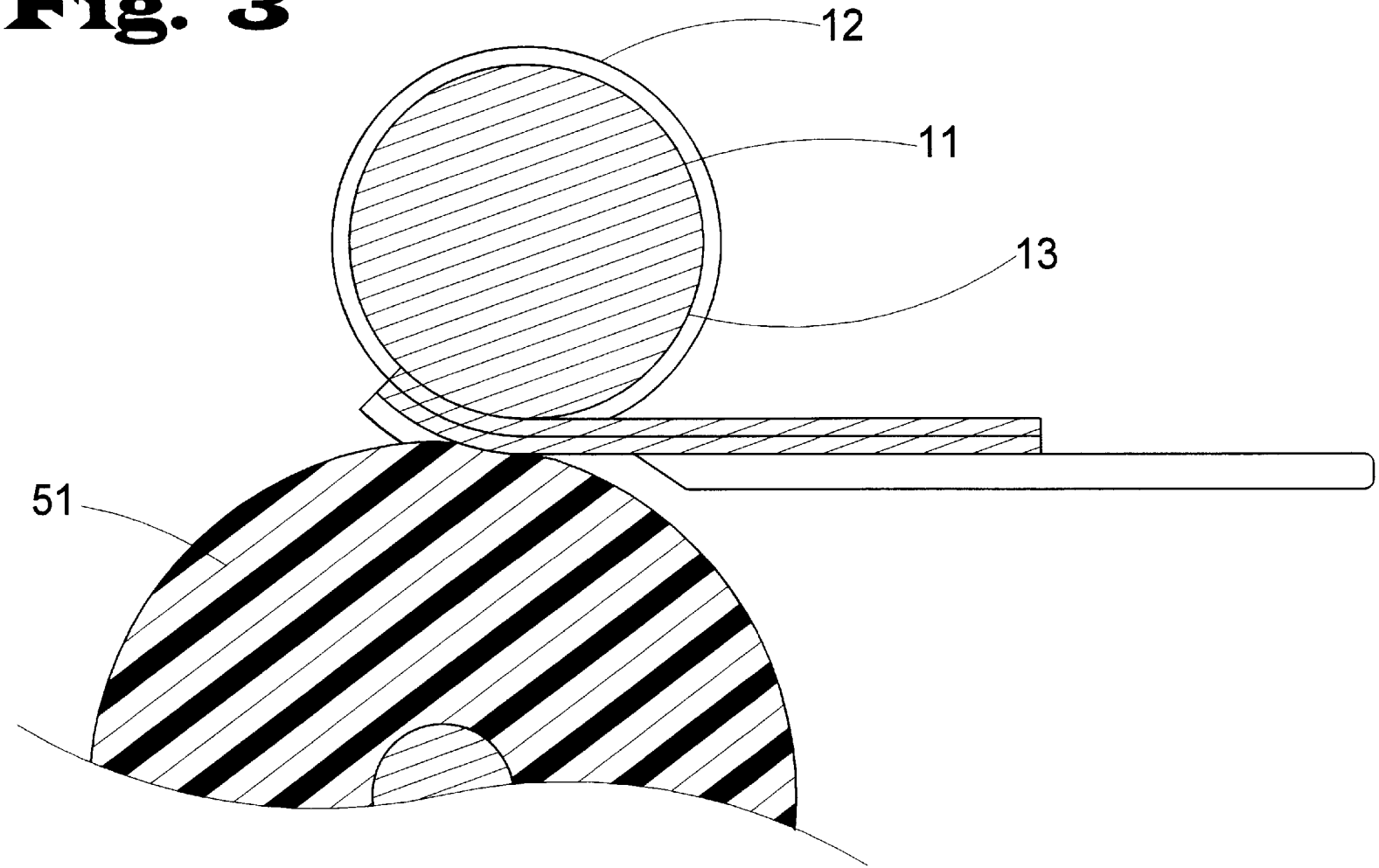
FIG. 3 is a cross-sectional view of the present invention taken along line 3—3 of FIG. 1.

In an embodiment, as shown in FIGS. 1 through 3, the body member 11 comprises a pair of mounting portions 16. Each of the mounting portions 16 outwardly extends from the opposing ends 15 of the body member 11. Each of the mounting portions 16 is aligned along a longitudinal axis of the body member 11. Each of the mounting portions 16 is designed for being engaged by a plurality of cam rollers 52 of the roll bending machine 50 for maintaining alignment of the body member 11 with the pliable roller 51 of the roll bending machine 50.

The body member 11 comprises a threaded shaft 17. The threaded shaft 17 outwardly extends from one of the mounting portions 16 whereby a longitudinal axis of the threaded shaft 17 is aligned with the longitudinal axis of the body member 11. The threaded shaft 17 is designed for extending through a mounting block 54 of the roll bending machine 50 whereby the threaded shaft 17 receives a threaded fastener 53 when the threaded shaft 17 is extended through the mounting block 54 of the roll bending machine 50 for securing the body member 11 to the mounting block 54 of the roll bending machine 50.

Figure 4:
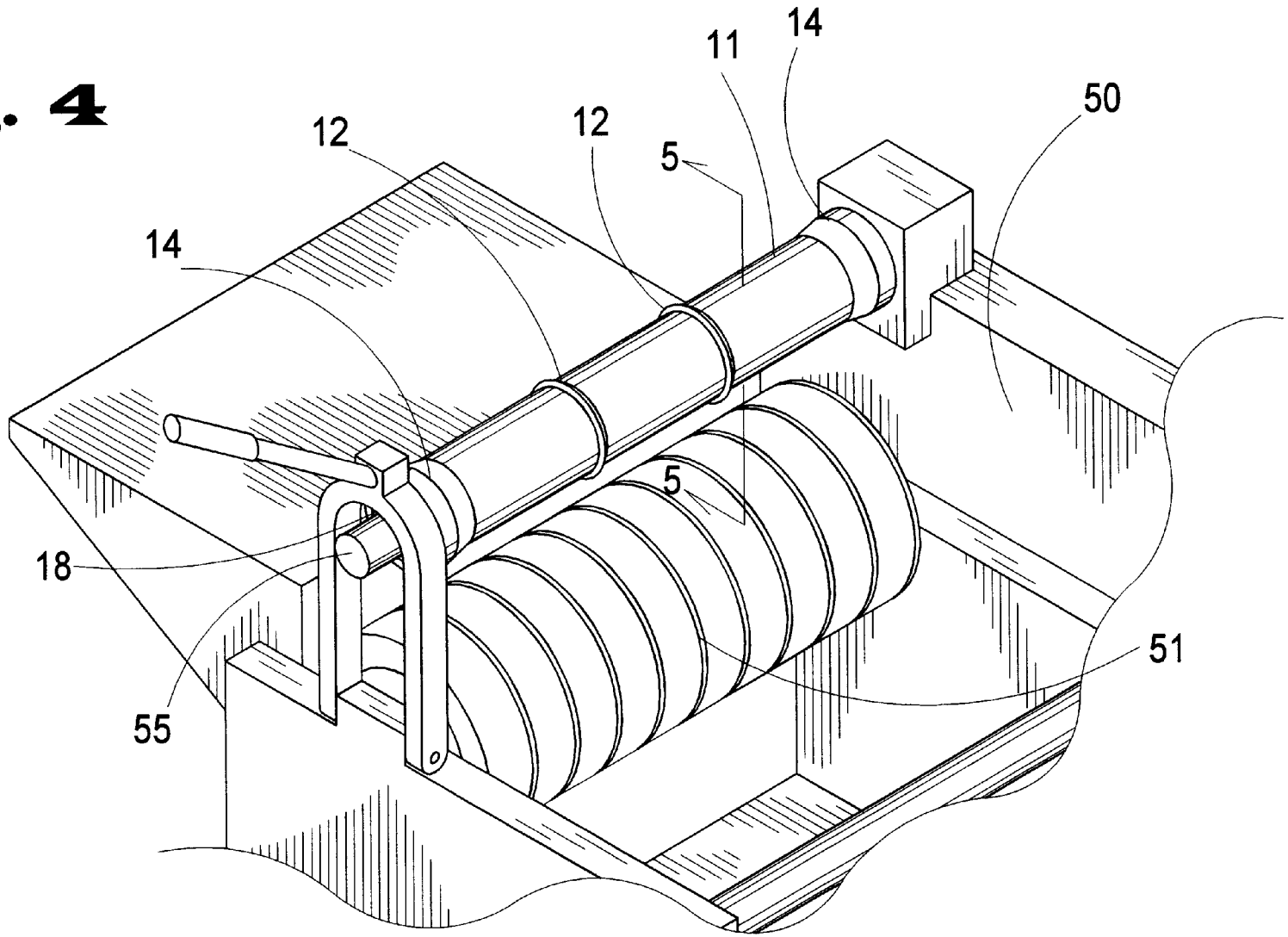
FIG. 4 is a perspective view of an embodiment of the present invention shown in use.
Figure 5:
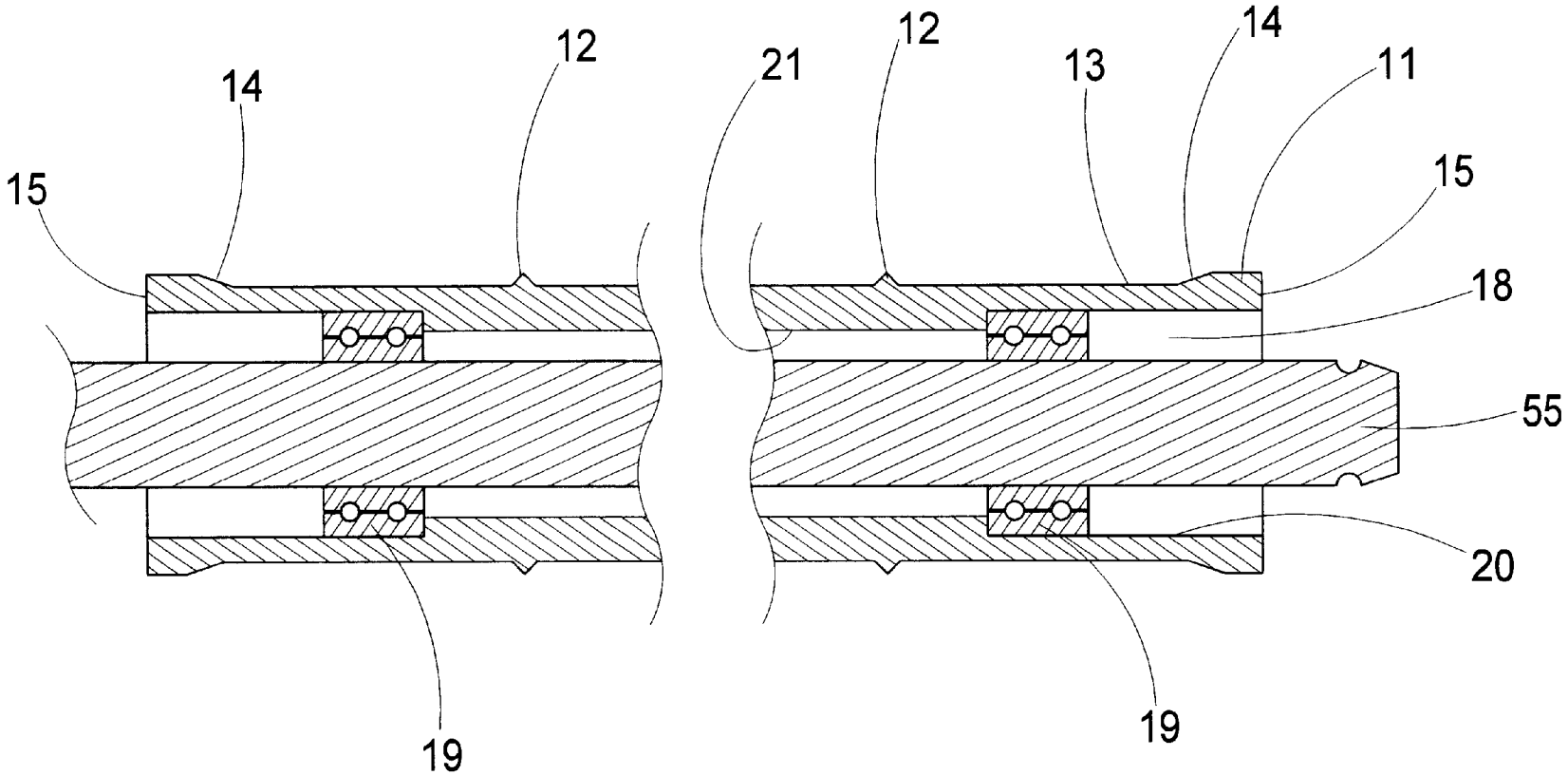
FIG. 5 is a cross-sectional view of the embodiment of the present invention taken along line 5—5 of FIG. 4.

In an embodiment, as shown in FIGS. 4 and 5, the body member 11 comprises a bore 18 extending through the body member 11 whereby the bore 18 extends between the opposing ends 15 of the body member 11. A longitudinal axis of the bore 18 of the body member 11 is aligned with the longitudinal axis of the body member 11. The bore 18 of the body member 11 is designed for receiving a stationary axle 55 of the roll bending machine 50 whereby the body member 11 is rotatably positioned around the stationary axle 55 of roll bending machine 50.

A plurality of bearing members 19 are positioned in the bore 18 of the body member 11 whereby each of the bearing members 19 abuts an interior face 20 of the body member 11. Each of the bearing members 19 is designed for being positioned between the body member 11 and the stationary axle 55 whereby each of the bearing members 19 is for maintaining alignment of the body member 11 with respect to the stationary axle 55 and permitting the body member 11 to rotate around the stationary axel when the body member 11 is being rotated by the pliable roller 51.

The body member 11 comprises an alignment portion 21. The alignment portion 21 extends into the bore 18 of the body member 11 from the interior face 20 of the body member 11. Each of the bearing members 19 abuts against the alignment portion 21 whereby the alignment portion 21 maintains annular alignment of the bearing members 19 with respect to the longitudinal axis of the body member 11 when the bearing members 19 are abutting the alignment portion 21.

Figure 6:
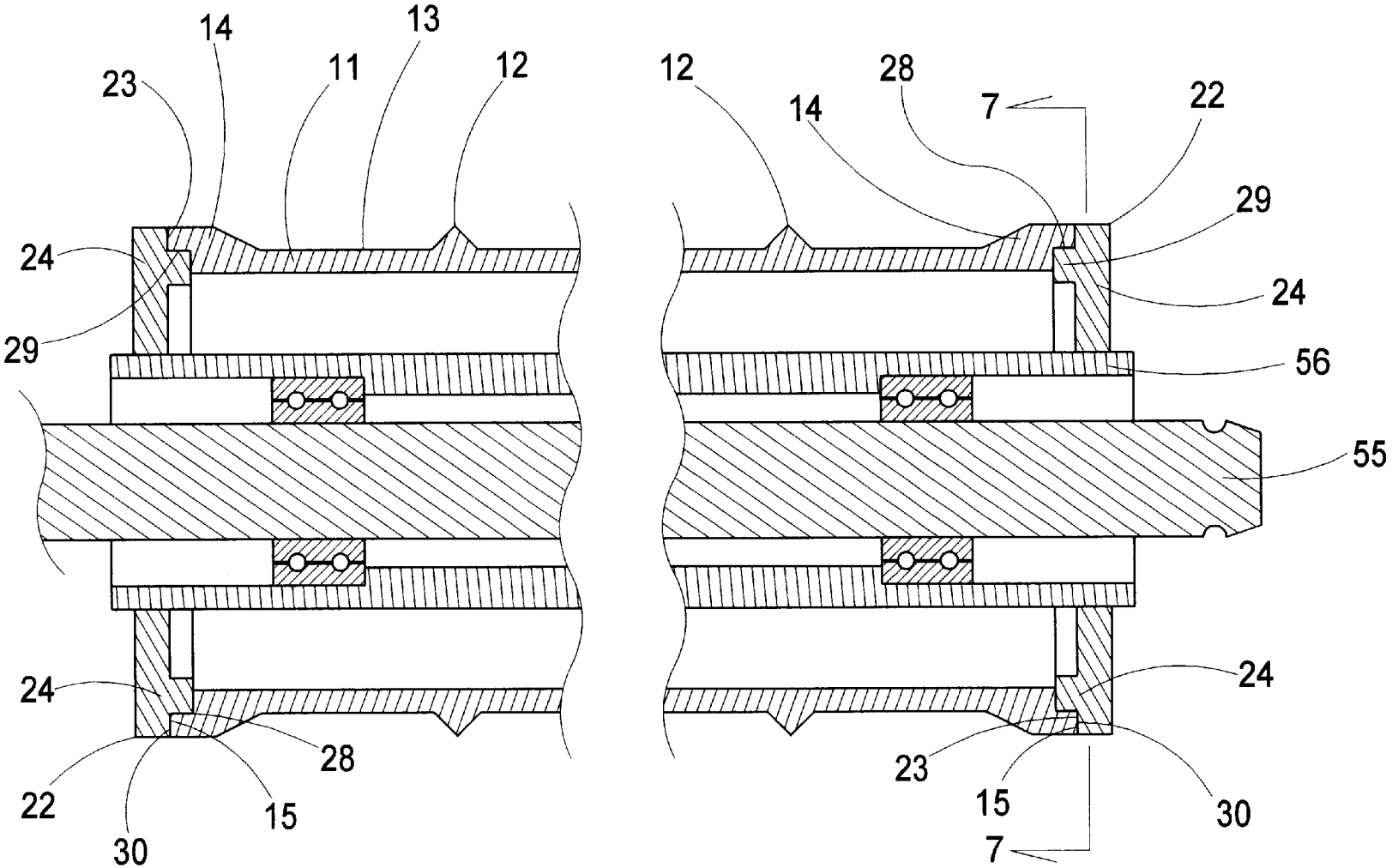
FIG. 6 is a cross-section view of an embodiment of the present invention shown in FIG. 4.
Figure 7:
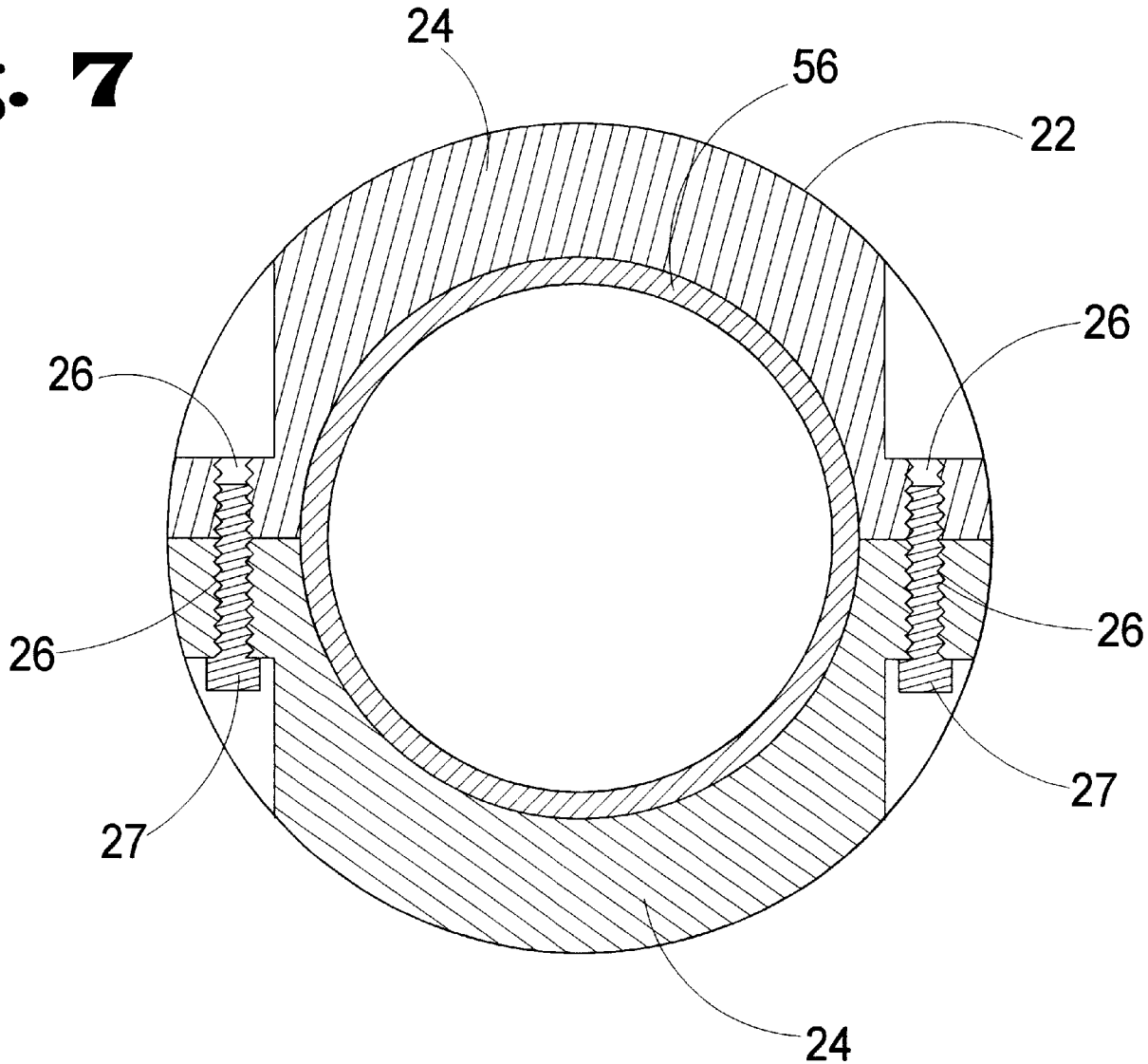
FIG. 7 is a cross-sectional view of one of the clamp members of the embodiment of the present invention taken along line 7—7 of FIG. 6.

In an embodiment, as shown in FIGS. 6 and 7, the body member 11 comprises a bore 18 extending through the body member 11 whereby the bore 18 extends between the opposing ends 15 of the body member 11. A longitudinal axis of the bore 18 of the body member 11 is aligned with the longitudinal axis of the body member 11. The bore 18 of the body member 11 is designed for engaging a roll tube 56 rotationally positioned around a stationary axle 55 of the roll bending machine 50 whereby the body member 11 is rotatably positioned around the stationary axle 55 of roll bending machine 50 when the body member 11 is rotated by the pliable roller 51.

A pair of clamp members 22 selectively engage an end face 23 of each of the opposing ends 15 of the body member 11. Each of the clamp members 22 is designed for engaging the roll tube 56 of the roll bending machine 50 whereby the clamp members 22 are for securing the body member 11 to the roll tube 56 of the roll bending machine 50.

Each of the clamp members 22 comprises a pair of clamp portions 24. One of the clamp portions 24 is selectively coupled to the other of the clamp portions 24 whereby each of the clamp portions 24 is designed for being positioned around the roll tube 56 of the roll bending machine 50 when the clamp portions 24 are coupled to together. Each of the clamp portions 24 comprises an arcuate interior face 25 20 whereby the arcuate interior face 25 20 of each of the clamp portions 24 is designed for frictionally engaging the roll tube 56 for inhibiting rotation of the clamp portions 24 with respect to the roll tube 56 when the clamp portions 24 are coupled together around the roll tube 56.

Each of the clamp portions 24 comprises a plurality of fastening apertures 26 extending through the clamp portions 24. Each of the fastening apertures 26 of one of the clamp portions 24 is alignable with one of the fastening apertures 26 of the other of the clamp portions 24. Each of a plurality of fastener members 27 selectively extends through one of the fastening apertures 26 of each of the clamp portions 24 when the fastening apertures 26 of each of the clamp portions 24 are aligned whereby each of the fastener members 27 engages the clamp portions 24 for coupling the clamp portions 24 together.

The body member 11 comprises a pair of alignment grooves 28. Each of the alignment grooves 28 extends into the body member 11 from the end face 23 of an associated one of the opposing ends 15 of the body member 11.

Each of the clamp members 22 comprises a lip portion 29. The lip portion 29 outwardly extends from an engagement face 30 the associated one the clamp members 22. The lip portion 29 of each of the clamp members 22 selectively extends into one of the alignment grooves 28 of the body member 11 when the engagement face 30 of each of the clamp members 22 abuts against the end face 23 of the associated one of the opposing ends 15 of the body member 11 for maintaining alignment of the body member 11 with respect to the roll tube 56.

In use, the user mounts the body member 11 onto the roll bending machine 50. The pliable roller 51 of the roll bending machine 50 is brought into engagement with the body member 11. As the roll bending machine 50 is turned on the pliable roller 51 is rotated and thereby rotates the body member 11. The material, or multiple layers of material, are placed against a guide fence of the feed table of the roll bending machine 50 to facilitate aligning of the material with body member 11. The material is then fed between the body member 11 and the pliable roller 51 to form the arcuate end product which is dispensed from machine opposite the user.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A roll bending die for being used with a roll bending machine for producing rib reinforced rolled material, the roll bending die comprising:

a body member being adapted for being rotatably coupled to the roll bending machine such that said body member selectively engages a pliable roller of the roll bending machine, said body member being adapted for being rotated by the pliable roller when the pliable roller is rotated by the roll bending machine such that said body member rolls the material into an arc when the material is placed between said body member and the pliable roller;

said body member comprising at least one ridge portion outwardly extending from a perimeter face of said body member, said ridge portion being adapted for pressing a rib into the material when the material is rolled between said body member and the pliable roller of the roll bending machine; and said body member comprising a pair of mounting portions, each of said mounting portions outwardly extending from opposing ends of said body member, each of said mounting portions being aligned along a longitudinal axis of said body member, each of said mounting portions being adapted for being engaged by a plurality of cam rollers of the roll bending machine for maintaining alignment of said body member with the pliable roller of the roll bending machine.

2. The roll bending die as set forth in claim 1, wherein the ridge portion annularly extends around said body member such that said ridge portion extends around the circumference of said body member, said ridge portion being adapted for forming a circumferential ridge in the material when the material is rolled between said body member and the pliable roller for reinforcing the material against bending.

3. The roll bending die as set forth in claim 1, further comprising:

said body member comprising at least one flared ridge, said flared ridge outwardly extending from said perimeter face of said body member such that said flared ridge is adapted for forming a flared portion in the material when the material is rolled between said body member and the pliable roller.

4. The roll bending die as set forth in claim 3, wherein said flared ridge of said body member annularly extends around said body member such that said flared ridge extends around the circumference of said body member, said flared ridge being adapted for forming a circumferential flared portion in the material when the material is rolled between said body member and the pliable roller for reinforcing the material against bending.

5. The roll bending die as set forth in claim 4, wherein said flared ridge of said body member is positioned adjacent one of a pair of opposing ends of said body member such that said flared ridge is adapted for forming the circumferential flared portion adjacent one of a pair of free ends of the material when the material is rolled between said body member and the pliable roller.

6. The roll bending die as set forth in claim 1, further comprising:

said body member comprising a threaded shaft, said threaded shaft outwardly extending from one of said mounting portions such that a longitudinal axis of said threaded shaft is aligned with the longitudinal axis of said body member, said threaded shaft being adapted for extending through a mounting block of the roll bending machine such that said threaded shaft receives a threaded fastener when said threaded shaft is extended through the mounting block of the roll bending machine for securing said body member to the mounting block of the roll bending machine.

7. The roll bending die as set forth in claim 1, further comprising:

said body member comprising a bore extending through said body member such that said bore extends between opposing ends of said body member, a longitudinal axis of said bore of said body member being aligned with the longitudinal axis of said body member, said bore of said body member being adapted for receiving a stationary axle of the roll bending machine such that said body member is rotatably positioned around the stationary axle of roll bending machine; and a plurality of bearing members being positioned in said bore of said body member such that each of said bearing members abuts an interior face of said body member, each of said bearing members being adapted for being positioned between said body member and the stationary axle such that each of said bearing members is for maintaining alignment of said body member with respect to said stationary axle and permitting said body member to rotate around the stationary axel when said body member is being rotated by the pliable roller.

8. The roll bending die as set forth in claim 7, further comprising:

said body member comprising an alignment portion, said alignment portion extending into said bore of said body member from said interior face of said body member, each of said bearing members abutting against said alignment portion such that said alignment portion maintains annular alignment of said bearing members with respect to the longitudinal axis of said body member when said bearing members are abutting said alignment portion.

9. The roll bending die as set forth in claim 1, further comprising:

said body member comprising a bore extending through said body member such that said bore extends between opposing ends of said body member, a longitudinal axis of said bore of said body member being aligned with the longitudinal axis of said body member, said bore of said body member being adapted for engaging a roll tube rotationally positioned around a stationary axle of the roll bending machine such that said body member is rotatably positioned around the stationary axle of roll bending machine when said body member is rotated by the pliable roller.

10. The roll bending die as set forth in claim 9, further comprising:

a pair of clamp members selectively engaging an end face of each of said opposing ends of said body member, each of said clamp members being adapted for engaging the roll tube of the roll bending machine such that said clamp members are for securing said body member to the roll tube of the roll bending machine.

11. The roll bending die as set forth in claim 10, further comprising:

each of said clamp members comprising a pair of clamp portions, one of said clamp portions being selectively coupled to the other of said clamp portions such that each of said clamp portions are adapted for being positioned around the roll tube of the roll bending machine when said clamp portions are coupled to together, each of said clamp portions comprising an arcuate interior face such that said arcuate interior face of each of said clamp portions is adapted for frictionally engaging the roll tube for inhibiting rotation of said clamp portions with respect to the roll tube when said clamp portions are coupled together around the roll tube.

12. The roll bending die as set forth in claim 11, further comprising:

each of said clamp portions comprising a plurality of fastening apertures extending through said clamp portions, each of said fastening apertures of one of said clamp portions being alignable with one of said fastening apertures of the other of said clamp portions, each of a plurality of fastener members selectively extending through one of said fastening apertures of each of said clamp portions when said fastening apertures of each of said clamp portions are aligned such that each of said fastener members engages said clamp portions for coupling said clamp portions together.

13. The roll bending die as set forth in claim 10, further comprising:

said body member comprising a pair of alignment grooves, each of said alignment grooves extending into said body member from said end face of an associated one of said opposing ends of said body member; and each of said clamp members comprising a lip portion, said lip portion outwardly extending from an engagement face the associated one said clamp members, said lip portion of each of said clamp members selectively extending into one of said alignment grooves of said body member when said engagement face of each of said clamp members abuts against said end face of the associated one of said opposing ends of said body member for maintaining alignment of said body member with respect to said roll tube.

14. A roll bending die for being used with a roll bending machine for producing rib reinforced rolled material, the roll bending die comprising:

a body member being adapted for being rotatably coupled to the roll bending machine such that said body member selectively engages a pliable roller of the roll bending machine, said body member being adapted for being rotated by the pliable roller when the pliable roller is rotated by the roll bending machine such that said body member rolls the material into an arc when the material is placed between said body member and the pliable roller;

said body member comprising a plurality of ridge portions outwardly extending from a perimeter face of said body member, said ridge portions being adapted for pressing ribs into the material when the material is rolled between said body member and the pliable roller of the roll bending machine;

each of said ridge portions annularly extending around said body member such that each of said ridge portions extends around the circumference of said body member, said ridge portions being adapted for forming circumferential ridges in the material when the material is rolled between said body member and the pliable roller for reinforcing the material against bending;

said body member comprising a pair of flared ridges, each of said flared ridges outwardly extending from said perimeter face of said body member such that said flared ridges are adapted for forming a flared portion in the material when the material is rolled between said body member and the pliable roller;

each of said flared ridges of said body member annularly extending around said body member such that each of said flared ridges extends around the circumference of said body member, said flared ridges being adapted for forming circumferential flared portions in the material when the material is rolled between said body member and the pliable roller for reinforcing the material against bending;

each of said flared ridges of said body member being positioned adjacent one of a pair of opposing ends of said body member such that said flared ridges are adapted for forming the circumferential flared portions adjacent each of the free ends of the material when the material is rolled between said body member and the pliable roller; and said body member comprising a pair of mounting portions, each of said mounting portions outwardly extending from said opposing ends of said body member, each of said mounting portions being aligned along a longitudinal axis of said body member, each of said mounting portions being adapted for being engaged by a plurality of cam rollers of the roll bending machine for maintaining alignment of said body member with the pliable roller of the roll bending machine.

15. The roll bending die as set forth in claim 14, further comprising:

said body member comprising a threaded shaft, said threaded shaft outwardly extending from one of said mounting portions such that a longitudinal axis of said threaded shaft is aligned with the longitudinal axis of said body member, said threaded shaft being adapted for extending through a mounting block of the roll bending machine such that said threaded shaft receives a threaded fastener when said threaded shaft is extended through the mounting block of the roll bending machine for securing said body member to the mounting block of the roll bending machine.

16. The roll bending die as set forth in claim 14, further comprising:

said body member comprising a bore extending through said body member such that said bore extends between said opposing ends of said body member, a longitudinal axis of said bore of said body member being aligned with the longitudinal axis of said body member, said bore of said body member being adapted for receiving a stationary axle of the roll bending machine such that said body member is rotatably positioned around the stationary axle of roll bending machine; and a plurality of bearing members being positioned in said bore of said body member such that each of said bearing members abuts an interior face of said body member, each of said bearing members being adapted for being positioned between said body member and the stationary axle such that each of said bearing members is for maintaining alignment of said body member with respect to said stationary axle and permitting said body member to rotate around the stationary axel when said body member is being rotated by the pliable roller.

17. The roll bending die as set forth in claim 16, further comprising:

said body member comprising an alignment portion, said alignment portion extending into said bore of said body member from said interior face of said body member, each of said bearing members abutting against said alignment portion such that said alignment portion maintains annular alignment of said bearing members with respect to the longitudinal axis of said body member when said bearing members are abutting said alignment portion.

18. The roll bending die as set forth in claim 14, further comprising:

said body member comprising a bore extending through said body member such that said bore extends between said opposing ends of said body member, a longitudinal axis of said bore of said body member being aligned with the longitudinal axis of said body member, said bore of said body member being adapted for engaging a roll tube rotationally positioned around a stationary axle of the roll bending machine such that said body member is rotatably positioned around the stationary axle of roll bending machine when said body member is rotated by the pliable roller.

19. The roll bending die as set forth in claim 18, further comprising:

a pair of clamp members selectively engaging an end face of each of said opposing ends of said body member, each of said clamp members being adapted for engaging the roll tube of the roll bending machine such that said clamp members are for securing said body member to the roll tube of the roll bending machine.

20. The roll bending die as set forth in claim 19, further comprising:

each of said clamp members comprising a pair of clamp portions, one of said clamp portions being selectively coupled to the other of said clamp portions such that each of said clamp portions are adapted for being positioned around the roll tube of the roll bending machine when said clamp portions are coupled to together, each of said clamp portions comprising an arcuate interior face such that said arcuate interior face of each of said clamp portions is adapted for frictionally engaging the roll tube for inhibiting rotation of said clamp portions with respect to the roll tube when said clamp portions are coupled together around the roll tube.

21. The roll bending die as set forth in claim 20, further comprising:

each of said clamp portions comprising a plurality of fastening apertures extending through said clamp portions, each of said fastening apertures of one of said clamp portions being alignable with one of said fastening apertures of the other of said clamp portions, each of a plurality of fastener members selectively extending through one of said fastening apertures of each of said clamp portions when said fastening apertures of each of said clamp portions are aligned such that each of said fastener members engages said clamp portions for coupling said clamp portions together.

22. The roll bending die as set forth in claims 19, further comprising:

said body member comprising a pair of alignment grooves, each of said alignment grooves extending into said body member from said end face of an associated one of said opposing ends of said body member; and each of said clamp members comprising a lip portion, said lip portion outwardly extending from an engagement face the associated one said clamp members, said lip portion of each of said clamp members selectively extending into one of said alignment grooves of said body member when said engagement face of each of said clamp members abuts against said end face of the associated one of said opposing ends of said body member for maintaining alignment of said body member with respect to said roll tube.

23. A roll bending die for being used with a roll bending machine for producing rib reinforced rolled material, the roll bending die comprising:

a body member being adapted for being rotatably coupled to the roll bending machine such that said body member selectively engages a pliable roller of the roll bending machine, said body member being adapted for being rotated by the pliable roller when the pliable roller is rotated by the roll bending machine such that said body member rolls the material into an arc when the material is placed between said body member and the pliable roller;

said body member comprising at least one ridge portion outwardly extending from a perimeter face of said body member, said ridge portion being adapted for pressing a rib into the material when the material is rolled between said body member and the pliable roller of the roll bending machine;

said body member comprising a bore extending through said body member such that said bore extends between opposing ends of said body member, a longitudinal axis of said bore of said body member being aligned with the longitudinal axis of said body member, said bore of said body member being adapted for engaging a roll tube rotationally positioned around a stationary axle of the roll bending machine such that said body member is rotatably positioned around the stationary axle of roll bending machine when said body member is rotated by the pliable roller; and a pair of clamp members selectively engaging an end face of each of said opposing ends of said body member, each of said clamp members being adapted for engaging the roll tube of the roll bending machine such that said clamp members are for securing said body member to the roll tube of the roll bending machine.

* * * * *